US007111928B2

(12) United States Patent
Satake et al.

(10) Patent No.: US 7,111,928 B2
(45) Date of Patent: Sep. 26, 2006

(54) PIEZOELECTRIC INK JET HEAD

(75) Inventors: Kenichi Satake, Kyoto (JP); Kenichi Yoshimura, Kokubu (JP)

(73) Assignee: Kyocera Corporation, Kyoto (JP)

( * ) Notice: Subject to any disclaimer, the term of this patent is extended or adjusted under 35 U.S.C. 154(b) by 218 days.

(21) Appl. No.: 10/848,914

(22) Filed: May 19, 2004

(65) Prior Publication Data

US 2004/0233257 A1 Nov. 25, 2004

(30) Foreign Application Priority Data

May 23, 2003 (JP) ..... 2003-146834

(51) Int. Cl.
*B41J 2/045* (2006.01)

(52) U.S. Cl. ..... 347/71

(58) Field of Classification Search ..... 347/68, 347/70–72

See application file for complete search history.

(56) References Cited

U.S. PATENT DOCUMENTS 6,217,161 B1 4/2001 Inose et al.

FOREIGN PATENT DOCUMENTS

| | | |
|---|---|---|
| GB | 2 345 882 | 7/2000 |
| JP | 05-004340 | 1/1993 |
| JP | 05-318731 | 12/1993 |
| JP | 0 875 381 | 10/1999 |
| JP | 1 116 588 | 7/2001 |
| JP | 2002-264328 | 9/2002 |

*Primary Examiner*—K. Feggins
(74) *Attorney, Agent, or Firm*—Hogan & Hartson LLP

(57) ABSTRACT

The present invention is directed to a piezoelectric ink jet head wherein the partition walls that separate the adjacent recesses that make the pressure chambers are formed to have such a cross sectional shape as the width $W_1$ in the planar direction at the upper end on the side of the substrate where the drive section is formed and height H in the direction of substrate thickness satisfy the expression (1):

$$W_1 \geqq H \quad (1)$$

while the width $W_1$ and $W_2$ of the lower end at the bottom of the recess of the substrate in the planar direction satisfy the expression (2):

$$W_1 \leqq W_2 \quad (2)$$

in order to prevent the dot size and dot shape of the picture to be formed from varying as the state of driving the individual drive regions or the state of driving the individual piezoelectric elements are influenced by the state of driving the other plurality of drive regions or the state of driving the individual piezoelectric elements that surround the former.

2 Claims, 4 Drawing Sheets

PIEZOELECTRIC INK JET HEAD

This application is based on application No. 2003-146834 filed with the Japanese Patent Office, the content of which is incorporated hereinto by reference.

TECHNICAL FIELD

The present invention relates to a piezoelectric ink jet head and, more particularly, to a piezoelectric ink jet head that can be preferably used in printer, copier, facsimile, and a composite machine which combines some of the former.

BACKGROUND OF THE INVENTION

For a piezoelectric ink jet head that uses the electrostrictive effect of a piezoelectric element as the drive power source and is employed in an on-demand type ink jet printer, one having such a constitution is widely employed that comprises a plurality of pressure chambers to be filled with an ink disposed on one side of a plate-shaped substrate along the surface, with a nozzle for discharging the ink provided to communicate with each of the pressure chambers and a drive section including the piezoelectric element provided for each of the pressure chambers, as described in Japanese Unexamined Patent Publication JP-H-05-318731-A2 (1993).

In the piezoelectric ink jet head described above, a drive voltage is individually applied to one or more of the piezoelectric elements each corresponding to each of the pressure chambers so as to deform, thereby decreasing the volume of the pressure chamber that corresponds to the piezoelectric element, so that the ink contained in the pressure chamber is discharged from the nozzle that communicates therewith in the form of ink droplet and a dot is formed on a sheet of paper.

More specifically, a drive section comprising the piezoelectric element and an oscillator plate that supports the piezoelectric element transmits a force generated by the piezoelectric element as a pressure to the ink contained in the pressure chamber, thereby to function as a drive power source that discharges ink droplets through the nozzles that communicate with the pressure chambers. That is, the drive section causes the piezoelectric element to deform due to the drive voltage applied thereto, so that the oscillator plate is caused to deflect and protrude toward the pressure chamber, thereby decreasing the volume of the pressure chamber and pressurizing the ink in the pressure chamber, so that an ink droplet is discharged from the tip of the nozzle.

At the same time, since the oscillator plate is caused by the pressure of the ink contained in the pressure chamber to deflect in a direction opposite to that described above, the drive section also acts as an elastic body with respect to the vibration of the ink in the head.

When a drive voltage is applied to the piezoelectric element so as to generate a force, the ink contained in the head undergoes vibration under the pressure transmitted via the oscillator plate from the drive section. This vibration is generated as the drive section and the pressure chamber act as the elasticity against the inertia of a feeder port that feeds the ink to the pressure chamber, a nozzle passage that communicates with the pressure chamber and the nozzle, and the nozzle. Natural period of vibration of volumetric velocity of the ink contained in the head during this vibration is determined by the dimensions of the components described above, physical properties of the ink and dimensions and physical properties of the drive section.

In the piezoelectric ink jet head, an ink droplet is discharged by utilizing the vibration of ink meniscus in the nozzle due to the vibration of the ink described above, thereby forming a dot on the paper surface.

In order to achieve a higher resolution of the piezoelectric ink jet head while decreasing the size of the piezoelectric ink jet head, pitch of arranging the nozzles must be made as small as possible. When resolution of the piezoelectric ink jet head becomes higher and the number of nozzles increases, however, it becomes difficult to dispose the independent piezoelectric elements individually in correspondence to the pressure chambers. For this reason, it has recently become a prevailing practice to employ a piezoelectric ink jet head having a piezoelectric element made in a thin plate of transverse vibration mode that is formed integrally with an electrode (common electrode), lower (oscillator plate side) one of a pair of electrodes that are disposed to sandwich the piezoelectric element for applying the drive voltage to the piezoelectric element, and the oscillator plate, in such a size that covers the plurality of pressure chambers (hereinafter referred to as a "common element type"). Of the pair of electrodes, the electrode that is disposed over the piezoelectric element (individual electrode) is separately formed in a predetermined shape that corresponds to each pressure chamber for applying drive voltage individually to each piezoelectric element.

In the piezoelectric ink jet head of common element type, when an electric field is generated by applying the drive voltage from the individual electrode to the region sandwiched by the individual electrode and the common electrode in the plane of the piezoelectric element (hereafter referred to as a "drive region"), the drive region can be driven like an independent piezoelectric element thereby pressurizing the ink in the corresponding pressure chamber.

In case adjacent pressure chambers are disposed too close to each other, however, there arises such a problem that, when the piezoelectric element (drive region in the case of common element type) that corresponds to a particular one of the pressure chambers is driven, the piezoelectric element (or the drive region) corresponding to the adjacent pressure chambers that surround the particular pressure chamber are subject to the influence of driving of the piezoelectric element. This problem is conspicuous particularly in the piezoelectric ink jet head of common element type.

Specifically, in the piezoelectric ink jet head of common element type, the piezoelectric element 9 made in a thin plate of transverse vibration mode is fixed at the upper end face of a partition wall 1*e* of the substrate 1, that separates the adjacent pressure chambers 2, via the common electrode 8 and the oscillator plate 7, whereby the piezoelectric element 9 has such a structure as the non-driving region fixed on the upper end face of the partition wall 1*e* constrains the periphery of the drive region that is defined by the planar configuration of the individual electrodes 10, as shown in FIG. 6.

When the drive voltage is applied to the individual electrode 10 located at the second position from the far left in the figure so as to drive the drive region of the piezoelectric element 9 that corresponds to the above-mentioned individual electrode 10 thereby causing the drive region, the common electrode 8 that is disposed right under thereof and the oscillator plate 7 to deform in the direction indicated by the hollow arrow (hereafter referred to as a "positive direction") in FIG. 7 so that volume of the pressure chamber 2 decreases and the ink is discharged, then the drive regions of the oscillator plate 7, the common electrode 8 and the piezoelectric element 9 located above the pressure chambers 2 located on both sides of the above-mentioned pressure chamber 2 deform in the direction of increasing the volume of the pressure chamber 2 (hereafter referred to as a "negative direction") as indicated by black arrow, although the figure shows only one side.

As a result, under the condition shown in FIG. 7, when the drive voltage is further applied to the individual electrodes 10 located above the adjacent pressure chambers 2 that have deformed in the negative direction so as to drive the drive region of the piezoelectric element 9 corresponding to the individual electrode 10, the amount of deformation in the positive direction becomes the amount of deformation in the positive direction, achieved by independently driving the drive region in question without driving the drive regions on both sides thereof, minus the amount of deformation in the negative direction described above. In consequence, pressure applied via the oscillator plate 7 to the ink in the pressure chamber 2 right below thereof for discharging the ink decreases accordingly, resulting in a smaller ink droplet discharged from the nozzle and/or a lower discharging speed that causes smaller dot size and/or deformed dot shape.

This phenomenon occurs simultaneously in a plurality of drive regions that are disposed in the planar direction of the piezoelectric element 9 of thin-plate construction.

In case the drive regions on both sides of one drive region of the piezoelectric element 9 are driven and, under this condition, the drive region interposed therebetween is driven, the amount of deformation of the drive region in the positive direction becomes even smaller than that of the case described above.

State of driving a particular drive region is also under influence of the state of driving the drive regions located beyond the adjacent drive regions, or the state of driving other neighboring drive regions, for example, although the magnitude of the influence is far smaller than that of the adjacent drive regions.

Thus when attention is focused on a particular drive region, the amount of deformation of the drive region in the positive direction varies depending on the state of driving the plurality of surrounding drive regions, namely the dot pattern of the picture to be formed, resulting in variability in dot size and/or dot shape.

The phenomenon described above occurs similarly also in the conventional type (hereafter referred to as a "separated element type") where separate piezoelectric elements are provided for the individual pressure chambers. In this case, deformations of the oscillator plate and of the common electrode disposed thereon influence the piezoelectric element disposed on the adjacent pressure chambers.

SUMMARY OF THE INVENTION

An object of the present invention is to provide a piezoelectric ink jet head that does not allow the dot size and/or dot shape to change regardless of the dot pattern of the picture to be formed, since the state of driving the individual drive region or the individual piezoelectric elements is not affected by the state of driving the plurality of other drive regions or the piezoelectric elements.

In order to achieve the object described above, the present inventors reviewed the structure of the piezoelectric ink jet head.

Through the reviewing investigation, the present inventors have found that the phenomenon described above occurs in the conventional piezoelectric ink jet head because the pressure chambers are disposed too closely to each other and therefore height of the partition wall, that separates the adjacent pressure chambers, in the direction of substrate thickness is larger than the width thereof in the planar direction.

A piezoelectric ink jet head of common element type will be taken as an example in the following more detailed description. The partition wall 1*e* has height h in the direction of substrate thickness that is larger than width w in the planar direction as shown in FIG. 6. As a result, when a particular drive region is driven as shown in FIG. 7, the drive region contracts in the planar direction so that the upper end of the partition wall 1*e* that constitutes the non-driven region surrounding the drive region is pulled toward the pressure chamber 2. The partition wall 1*e* that is caused by the pulling force to tilt toward the pressure chamber 2 affects the adjacent drive regions.

Based on this finding, the present inventors investigated the possibility of preventing the tilting deformation of the partition wall by forming the partition wall to have such a cross sectional shape as the width $W_1$ in the planar direction at the upper end on the side of the substrate where the drive section is formed and height H in the direction of substrate thickness satisfy the expression (1):

$$W_1 \geqq H \quad (1)$$

while the width $W_1$ and the width $W_2$ of the lower end at the bottom of the recess of the substrate in the planar direction satisfy the expression (2):

$$W_1 \leqq W_2 \quad (2).$$

It was found that the state of driving the individual drive region can be prevented from being affected by the state of driving the surrounding drive regions. It was also found that the same can be said of the piezoelectric ink jet head of separated element type.

Thus the invention described in claim 1 is a piezoelectric ink jet head comprising a plate-shaped substrate with a plurality of recesses that form pressure chambers to be filled with ink and are separated by partition walls, which are part of the substrate, being formed in the direction of substrate surface on one side of the substrate, while nozzles for discharging the ink contained in the pressure chambers in the form of droplets are disposed so as to communicate with the respective recesses via nozzle passages, and a common feed path is disposed to communicate via a feed port with the recesses for supplying the ink to the pressure chambers, the substrate being provided, on the surface thereof where the recesses are formed, with a drive section comprising:

a piezoelectric element made in a thin plate of transverse vibration mode;

an oscillator plate that closes the recesses so as to form the pressure chambers and oscillates as the piezoelectric element deforms thereby to decrease the volume of some of the pressure chambers and discharge the ink from the pressure chamber through the nozzle in the form of droplet; and upper and lower electrodes that sandwich the piezoelectric element on the upper and lower sides, wherein the partition wall that separates adjacent recesses has such a cross sectional shape as the width $W_1$ in the planar direction at the upper end on the side of the substrate where the drive section is formed and height H in the direction of substrate thickness satisfy the expression (1):

$$W_1 \geqq H \quad (1)$$

while the width $W_1$ and the width $W_2$ of the lower end at the bottom of the recess of the substrate in the planar direction satisfy the expression (2):

$$W_1 \leqq W_2 \quad (2).$$

In the piezoelectric ink jet head of the present invention, cross section of the partition wall preferably has trapezoidal shape with the width $W_1$ at the top smaller than the width $W_2$ at the bottom, in order to prevent the partition wall from deforming to tilt more reliably.

Thus the invention according to claim 2 is the piezoelectric ink jet head of claim 1 where widths $W_1$ and width $W_2$ satisfy the expression (2-1):

$$W_1 \leqq W_2 \quad (2\text{-}1).$$

The partition wall in the present invention refers to any walls that separate one pressure chamber from a plurality of surrounding pressure chambers. The problem of tilting partition wall can be eliminated by forming all of the partition walls that surround one pressure chamber with a cross section of such a shape that satisfies the relationships (1) and (2) described above.

However, there may be such a case as a small part of the partition wall has such a small thickness that does not satisfy the relationships (1) and (2) due, for example, to protrusion of the pressure chamber or tubing to the pressure chamber. The present invention includes such a case, too, if most of the partition walls continuing to the thin portion satisfy the relationships (1) and (2) and the partition walls as a whole do not experience tilting.

Although there is no limitation to the cross sectional shape of the partition walls that separate the pressure chambers which are provided along the periphery of the substrate from the outside, it is preferable that the partition walls formed on the periphery also satisfy the relationships (1) and (2), in order to prevent tilting and match the deforming characteristic of the driving region to that of the driving regions located over the pressure chambers formed in the inner portions.

DESCRIPTION OF THE PREFERRED EMBODIMENTS

Figure 1:
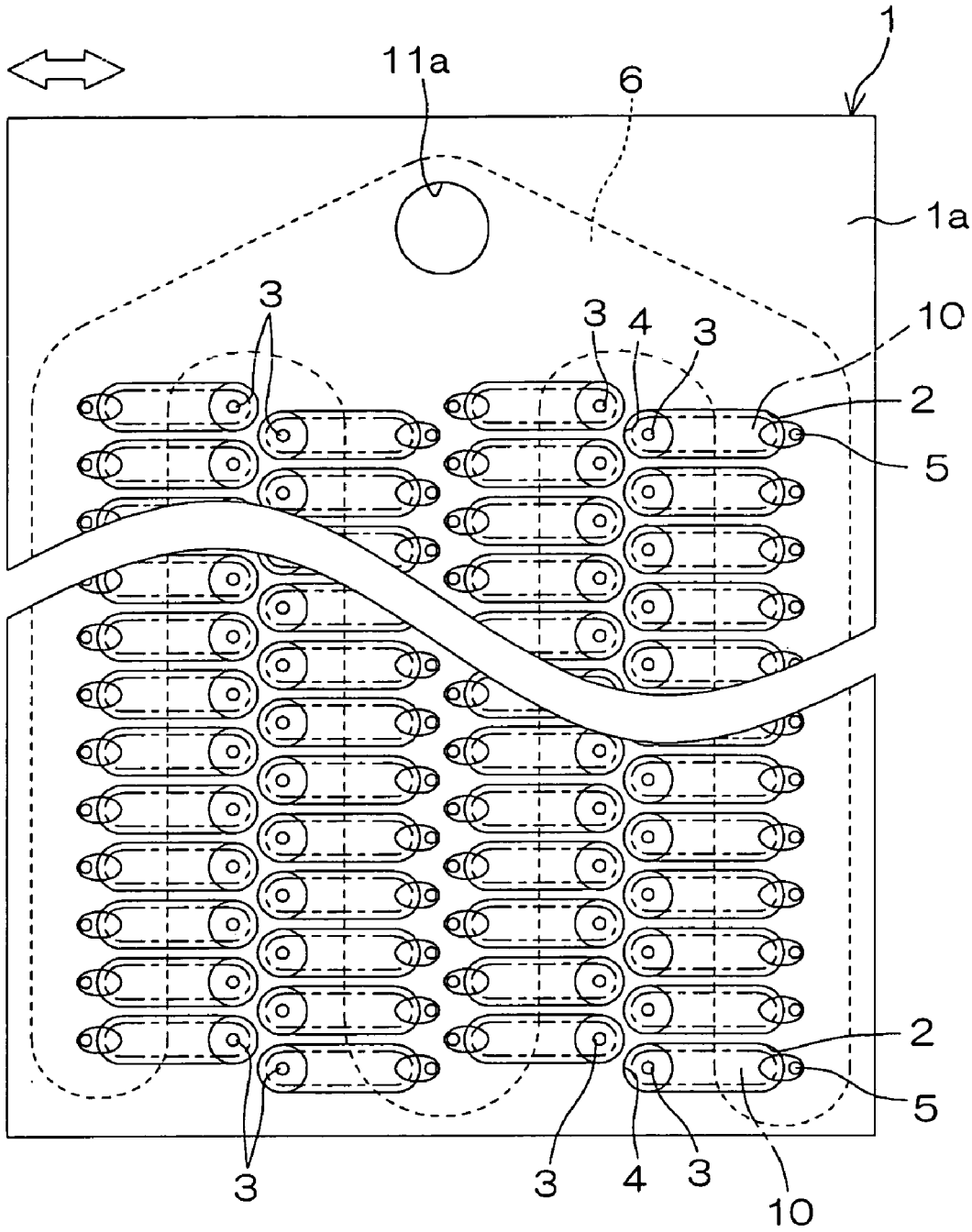
FIG. 1 is a plane view showing an example of piezoelectric ink jet head of the present invention, in a state before a drive section comprising a piezoelectric element and an oscillator plate is installed.

FIG. 1 is a plane view showing an example of the piezoelectric ink jet head of the present invention, in a state before the drive section comprising the piezoelectric element and the oscillator plate is installed.

The piezoelectric ink jet head of the example shown in FIG. 1 has a plurality of dot forming sections, each comprising a pressure chamber 2 and a nozzle 3 communicating thereto, disposed on a substrate 1.

Figure 2:
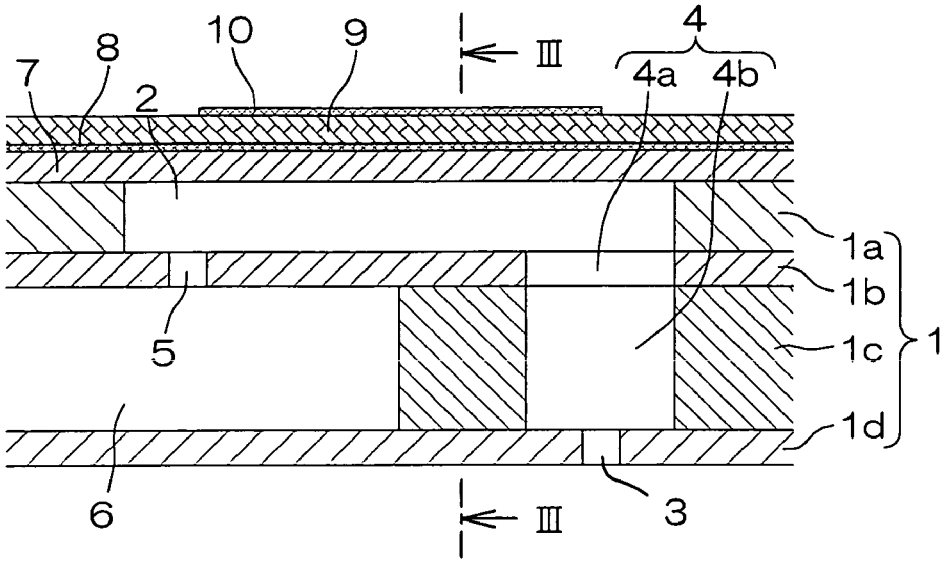
FIG. 2 is an enlarged sectional view of a dot forming section taken along lines A—A of FIG. 3 in the piezoelectric ink jet head of the example shown in FIG. 1 with the drive section installed thereon.
Figure 3:
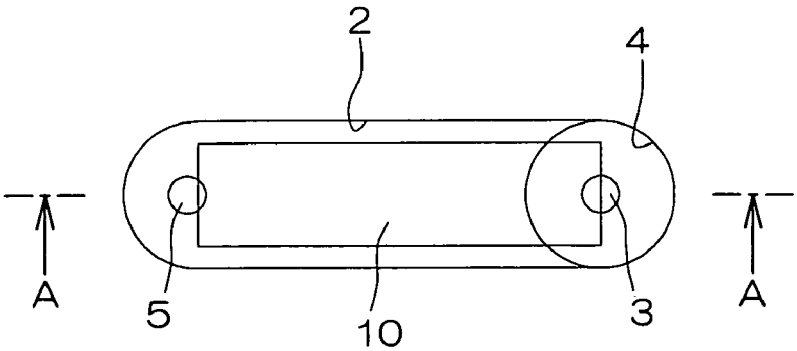
FIG. 3 is a perspective view showing the relationship between components constituting one of the dot forming sections.

FIG. 2 is an enlarged sectional view of a dot forming section in the piezoelectric ink jet head of the example described above with the drive section installed thereon. FIG. 3 is a perspective view showing the relationship between the components that constitute the dot forming section being stacked one on another.

Figure 4:
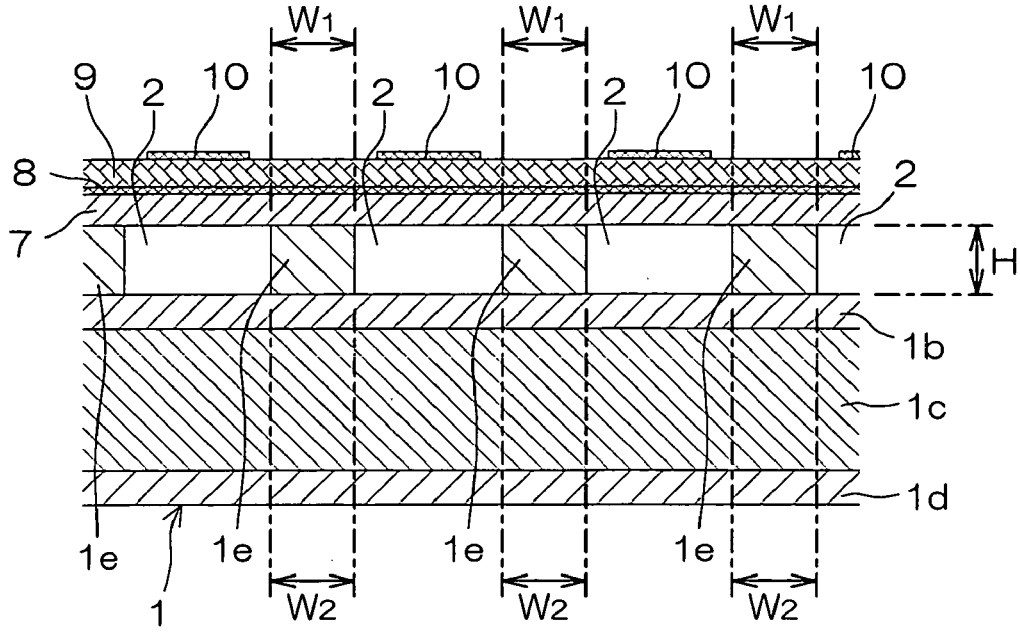
FIG. 4 is an enlarged sectional view taken along lines III—III of FIG. 2 showing a plurality of pressure chambers of the example of the piezoelectric ink jet head arranged in the direction perpendicular to the direction of FIG. 2.

FIG. 4 is an enlarged sectional view showing the plurality of pressure chambers of the above example of the piezoelectric ink jet head arranged in the direction perpendicular to the direction of FIG. 2.

The pressure chambers 2 and the nozzles 3 of each dot forming section are disposed in plurality along the principal scan direction indicated by the white arrow in FIG. 1. The dot forming sections are disposed in four rows, in the example shown in the figure, while the dot forming sections are arranged at a pitch of 90 dpi in the same row, thus achieving a resolution of 360 dpi in the piezoelectric ink jet head as a whole.

Each of the dot forming sections comprises the pressure chamber 2 that is a recess formed on the upper surface of the substrate 1 as shown in FIG. 2 and has a plan configuration of a rectangular mid portion interposed by semicircular portions connected to both ends thereof (refer to FIG. 3) and a nozzle 3 formed at a position that corresponds to the center of the semicircle at one end of the pressure chamber 2 on the lower surface of the substrate 1, the pressure chamber 2 and the nozzle 3 being connected with a nozzle passage 4 that has circular cross section of the same diameter as that of the semicircle located at the end, while the pressure chamber 2 is connected to a common feed path 6 (indicated with dashed line in FIG. 1) that is formed so as to connect the dot forming sections in the substrate 1, via a feed port 5 formed at a position that corresponds to the center of the semicircle at the other end of the pressure chamber 2.

The pressure chambers 2 are disposed at even intervals while being separated by partition walls 1*e* in a same row in a direction perpendicular to that of FIG. 2, as shown in FIG. 4.

In the example shown, the components described above have such a constitution as a first substrate 1*a* whereon the pressure chambers 2 are formed, a second substrate 1*b* whereon an upper portion 4*a* of the nozzle passage 4 and the feed port 5 are formed, a third substrate 1*c* having a lower portion 4*b* of the nozzle passage 4 and the common feed path 6 are formed, and a fourth substrate 1*d* whereon the nozzles 3 are formed, are stacked in this order so as to form an integral structure.

The first substrate 1*a* and the second substrate 1*b* have through holes 11*a* formed therein so as to constitute a joint for connecting the common feed path 6 formed on the third substrate 1*c* and the tubing that runs from an ink cartridge which is not shown in the drawing, on the upper surface of the substrate 1, as shown in FIG. 1.

The substrates 1*a* through 1*d* are made of a resin or a metal in the form of plate of predetermined thickness having the through holes formed therein by etching using photolithography process or the like. The partition walls 1*e* occupy the rest of the first substrate 1*a* left after forming the through holes that constitute the pressure chambers 2.

The partition walls 1*e* are formed to have such a cross sectional shape as the width $W_1$ in the planar direction at the upper end on the side where the drive section is formed and height H in the direction of substrate thickness satisfy the expression (1):

$$W_1 \geq H \quad (1)$$

while the width $W_1$ and the width $W_2$ of the lower end at the bottom of the recess of the substrate in the planar direction satisfy the equation (2-2):

$$W_1 = W_2 \quad (2\text{-}2).$$

Widths $W_1$ and $W_2$ of the partition walls 1*e* are determined by the interval of forming the through holes in the first substrate 1*a* to make the pressure chambers 2, and height H is determined by the thickness of the first substrate 1*a*. Therefore, the thickness of the first substrate 1*a* and the interval of forming the through holes that make the pressure chambers 2 may be determined so that widths $W_1$, $W_2$ and height H of the partition walls 1*e* satisfy the relations (1) and (2-2) while meeting the requirements of the piezoelectric ink jet head such as the pitch of dots to be formed and volume of the pressure chamber 2.

It goes without saying that the partition walls running in other directions surrounding the pressure chambers 2 are also formed in such a cross sectional shape that satisfies the relations (1) and (2-2), although not shown in the figure.

Forming the partition walls 1*e* in such a cross sectional shape as described above makes it possible to prevent the partition walls 1*e* that surround a particular drive region from deforming to tilt when the drive region is driven to cause the drive region to contract in the planar direction. As a result, pictures of good quality can be formed by preventing the size and shape of dots from changing with the dot pattern of the picture to be formed.

The substrate 1 has, on the upper surface thereof, a drive section constituted from an oscillator plate 7 having the such an area that covers at least the dot forming sections, a thin film of common electrode 8 having substantially the same size as the oscillator plate 7, a thin plate of piezoelectric element 9 of transverse vibration mode having substantially the same size as the oscillator plate 7 and the common electrode 8 being stacked in this order, while the plurality of individual electrodes 10 are separately formed on the piezoelectric element 9 at positions that correspond to the centers of the pressure chambers 2 of the dot forming sections as indicated by dot and dash line in FIG. 1.

The drive section constituted from the components described above can be fabricated by using a green sheet of piezoelectric material that would make a thin plate of piezoelectric material when fired.

For example, a green sheet of piezoelectric material is printed or coated on one side thereof with an electrically conductive paste that would become the common electrode when fired and, with another green sheet of piezoelectric material being stacked thereon, the stack is fired to form a laminate of such a constitution as the common electrode 8 is sandwiched by two thin piezoelectric layers. Then a plurality of individual electrodes 10 are formed on the surface of one piezoelectric layer of this laminate, and the drive section having such a constitution is obtained as the piezoelectric layer sandwiched by the common electrode 8 and the individual electrode 10 serves as the piezoelectric element 9 and the other piezoelectric layer serves as the oscillator plate 7.

A piezoelectric material used in forming the oscillator plate 7 and the piezoelectric element 9 of the drive section described above may be lead zirconate titanate (PZT), or PZT-based piezoelectric material made by adding one or more oxide of a metal such as lanthanum, barium, niobium, zinc, nickel or manganese to PZT, such as PLZT, for example, may be used. Lead magnesium niobate (PMN), lead nickel niobate (PNN), lead zinc niobate, lead manganese niobate, lead antimony stannate, lead titanate or barium titanate may be contained as a major component. The green sheet of the piezoelectric material contains a compound that would make some of the piezoelectric material described above when fired.

The electrically conductive paste used in forming the common electrode 8 contains powder of a metal having high electrical conductivity such as gold, silver, platinum, copper or aluminum. The common electrode 8 is formed by firing a layer of such an electrically conductive paste together with the green sheet of piezoelectric material so that the metal powder contained in the paste is sintered or melted and is integrated with the entire material.

The individual electrodes 10 may also be formed by printing an electrically conductive paste similar to that described above on the surface of one of the piezoelectric layer that would make the piezoelectric element 9, or by using a foil, plating film, vacuum vapor deposition film or the like of the metal that has high electrical conductivity such as those described above.

The oscillator plate 7 may also be formed from a metal.

For example, the oscillator plate 7 of plate shape having a predetermined thickness is formed from a single-element metal such as molybdenum, tungsten, tantalum, titanium, platinum, iron or nickel, an alloy of such metals or other metals such as stainless steel.

A green sheet of piezoelectric material similar to that described above is printed or coated on one side thereof with an electrically conductive paste that would become the common electrode when fired and is fired to form a laminate of the common electrode 8 and the thin plate of piezoelectric material. Then the oscillator plate 7 is bonded onto the surface of the laminate on the side of the common electrode 8, and a plurality of individual electrodes 10 are formed on the surface of the piezoelectric layer on the opposite side of this laminate, and the drive section having such a constitution is obtained as the piezoelectric layer serves as the piezoelectric element 9.

The piezoelectric ink jet head is obtained by securing the drive section, which has been integrally formed as described above, onto the substrate 1 by means of an adhesive or the like.

In order to operate the piezoelectric element 9 in transverse vibration mode, the piezoelectric material is controlled to polarize in the direction of thickness of the piezoelectric element 9, specifically in the direction from the individual electrode 10 toward the common electrode 8. For this purpose, known polarizing method may be employed such as high-temperature polarization, normal temperature polarization, alternate electric field superimposing or electric field cooling process. The piezoelectric element 9 may be subjected to aging treatment after polarization.

In the piezoelectric element 9 made of the piezoelectric material with the direction of polarization controlled as described above, the drive region sandwiched by the individual electrodes 10 and the common electrode 8 contracts within the plane perpendicular to the direction of polarization when a positive drive voltage is applied thereto from the individual electrode 10 with the common electrode 8 being grounded. Since the piezoelectric element 9 is fixed onto the oscillator plate 7 via the common electrode 8, however, the drive region that has contracted deflects toward the pressure chamber 2.

The deflection causes a change in pressure of the ink contained in the pressure chamber 2, and the change in pressure causes the ink to vibrate in the feed port 5, the pressure chamber 2, the nozzle passage 4 and the nozzle 3. As the velocity of vibration is directed toward the outside of the nozzle 3, ink meniscus in the nozzle 3 is pushed from the tip to the outside, thus forming the so-called column of ink.

While the column of ink is absorbed into the ink meniscus in the nozzle 3 as the velocity of vibration is directed toward the inside of the nozzle 3, the column of ink separates so as to form an ink droplet which flies toward the paper and forms a dot on the paper.

The body of ink of which volume has decreased by the volume of the droplet that has separated therefrom is retracted by the surface tension of the ink meniscus in the nozzle 3 so as to fill the nozzle 3 again from the ink cartridge through the tubing of the ink cartridge, the joint 11*a*, the common feed path 6, the feed port 5, the pressure chamber 2 and the nozzle passage 4.

The piezoelectric element 9 may also be formed separately for each of the pressure chamber 2, similarly to the individual electrodes 10.

Figure 5:
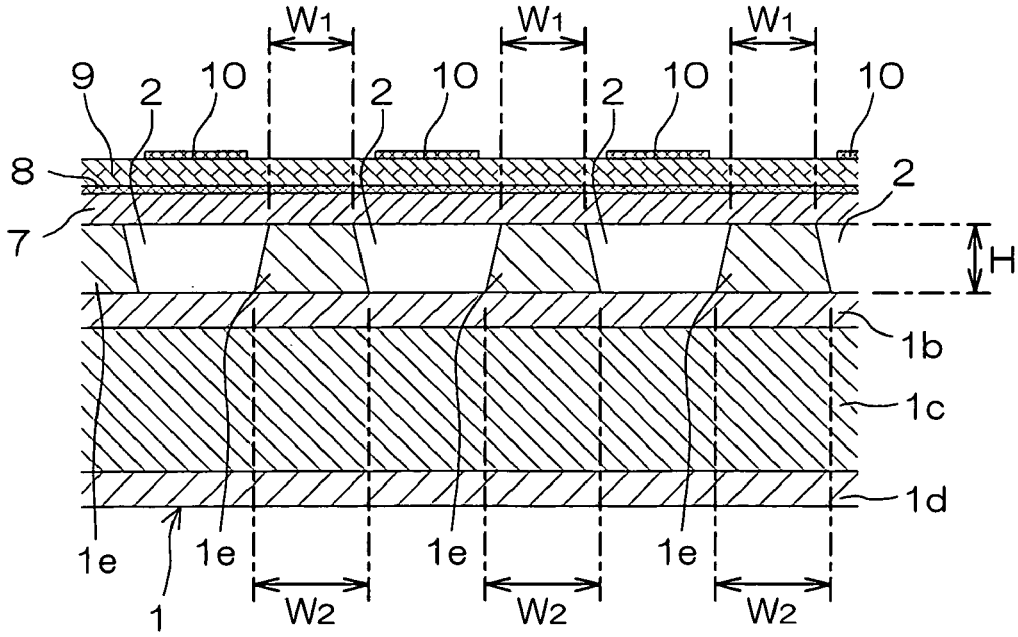
FIG. 5 is an enlarged sectional view taken along lines III—III of FIG. 2 showing a plurality of pressure chambers of a variation of the piezoelectric ink jet head arranged in the direction perpendicular to the direction of FIG. 2.
Figure 6:
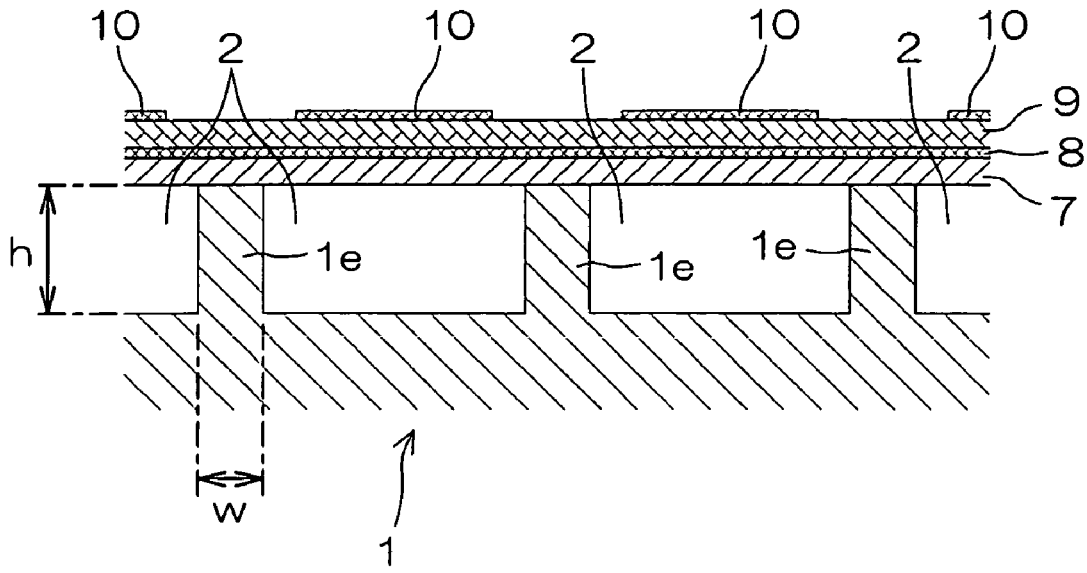
FIG. 6 is an enlarged sectional view showing a plurality of pressure chambers arranged close to each other via thin partition walls in an example of piezoelectric ink jet head of the prior art.
Figure 7:
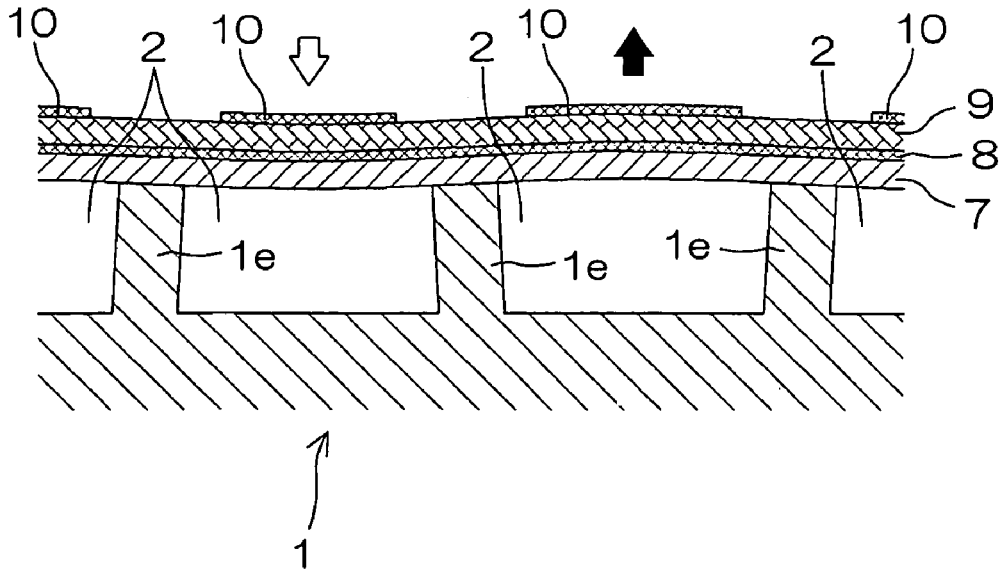
FIG. 7 is a sectional view explanatory of, in case a driving region located over one pressure chamber of the piezoelectric ink jet head described above is driven, the influence of the driving on the drive regions located over the surrounding pressure chambers and the partition walls.

FIG. 5 is an enlarged sectional view showing a plurality of pressure chambers of another example of the piezoelectric ink jet head of the present invention arranged in the direction perpendicular to the direction of FIG. 2.

In the example shown in the figure, the partition wall 1*e* are formed to have such a trapezoidal section as the width $W_1$ and height H satisfy the expression (1):

$$W_1 \geqq H \quad (1)$$

while the widths $W_1$ and $W_2$ satisfy the expression (2-1):

$$W_1 < W_2 \quad (2\text{-}1).$$

This constitution makes it possible to form pictures of even higher quality, since the partition walls 1*e* that surround the particular drive region can be prevented more reliably from deforming so as to tilt due to the contraction of the drive region in the planar direction when the drive region is driven.

There is no limitation to what extent the width $W_2$ is increased over the width $W_1$, namely the upper limit of width $W_2$. However, since the larger the width $W_2$ is, the smaller the volume of the pressure chamber 2 becomes, it is preferable to control the width $W_2$ to satisfy the expression (2-3):

$$W_2 \leqq W_1 + 2H \quad (2\text{-}3)$$

In order to form the partition walls 1*e* with the cross sectional shape described above, through holes that make the pressure chambers 2 may be formed by anisotropic etching in the first substrate 1*a*.

The first substrate 1*a* may also be formed from a number of thin sheets of which thickness is a fraction of the thickness of the first substrate 1*a*. In this case, the partition wall 1*e* having a trapezoidal section can be formed by stacking the sheets that have through holes of planar shape which is the section of the through holes that would make the pressure chambers 2 and the partition walls divided in the direction of thickness.

Other components are similar to those of the example shown in FIG. 2, and will therefore be identified with the same reference numbers and description thereof will be omitted.

In this example, too, the piezoelectric element 9 can be separately formed for each of the pressure chambers 2, similarly to the individual electrodes 10.

EXAMPLE

Example 1

A piezoelectric ink jet head having the structure shown in FIG. 1 through FIG. 4 was fabricated with the pressure chamber 2 having area of 0.2 $mm^2$ and measuring 200 μm in width and 80 μm in depth, the nozzle 3 measuring 25 μm in diameter and 30 μm in length, the nozzle passage 4 measuring 200 μm in diameter and 800 μm in length, the feed port 5 measuring 25 μm in diameter and 30 μm in length, and the partition walls 1*e* that separate the pressure chambers 2 having the width $W_1$ of 82 μm and the width $W_2$ of 82 μm. The height H of the partition wall 1*e* was 80 μm, the same as the depth of the pressure chamber 2.

Example 2

A piezoelectric ink jet head having the structure shown FIG. 1 through FIG. 3 and FIG. 5 was fabricated with the pressure chamber 2 having area of 0.2 $mm^2$ at the opening of the recess and measuring 200 μm in width at the opening of the recess and 80 μm in depth, the nozzle 3 measuring 25 μm in diameter and 30 μm in length, the nozzle passage 4 measuring 200 μm in diameter and 800 μm in length, the feed port 5 measuring 25 μm in diameter and 30 μm in length, and the partition walls 1*e* that separate the pressure chambers 2 having the width $W_1$ of 82 μm and the width $W_2$ of 98 μm. The height H of the partition wall 1*e* was 80 μm, the same as the depth of the pressure chamber 2.

Comparative Example 1

A piezoelectric ink jet head having the structure shown FIG. 1 through FIG. 4 was fabricated with the pressure chamber 2 having area of 0.2 $mm^2$ and measuring 200 μm in width and 80 μm in depth, the nozzle 3 measuring 25 μm in diameter and 30 μm in length, the nozzle passage 4 measuring 200 μm in diameter and 800 μm in length, the feed port 5 measuring 25 μm in diameter and 30 μm in length, and the partition walls 1*e* that separate the pressure chambers 2 having the width $W_1$ of 50 μm and the width $W_2$ of 50 μm. The height H of the partition wall 1*e* was 80 μm, the same as the depth of the pressure chamber 2.

Observation of Printing Quality

The piezoelectric ink jet heads of the example and the comparative example fabricated as described above were mounted on ink jet printers. A plurality of lines parallel to the principal scan direction of the head indicated by the white arrow in FIG. 1 and a plurality of lines perpendicular to the principal scan direction were printed so as to form a grid of 1 cm pitch with the same width of line in both directions.

With Comparative Example 1, the lines perpendicular to the principal scan direction were printed with smaller width. With Examples 1 and 2, in contrast, such a decrease in the line width did not occur and all lines in either direction were printed correctly with uniform width.

The invention claimed is:

1. A piezoelectric ink jet head comprising a plate-shaped substrate with a plurality of recesses that form pressure chambers to be filled with ink and are separated by partition walls, which are part of the substrate, being formed in the direction of substrate surface on one side of the substrate, while nozzles for discharging the ink contained in the pressure chambers in the form of droplets are disposed so as to communicate with the respective recesses via nozzle passages, and a common feed path is disposed to communicate via a feed port with the recesses for supplying the ink to the pressure chambers, the substrate being provided, on the surface thereof where the recesses are formed, with a drive section comprising:

a piezoelectric element made in a thin plate of transverse vibration mode;

an oscillator plate that closes the recesses so as to form the pressure chambers and oscillates as the piezoelectric element deforms thereby to decrease the volume of some of the pressure chambers and discharge the ink from the pressure chamber through the nozzle in the form of droplet; and upper and lower electrodes that sandwich the piezoelectric element on the upper and lower sides, wherein the oscillator plate is formed to cover a plurality of dot forming sections and the piezoelectric element is formed the same size as the oscillator plate; the partition wall that separates adjacent recesses has such a cross sectional shape as the width $W_1$ in the planar direction at the upper end on the side of the substrate where the drive section is formed and height H in the direction of the substrate thickness satisfy the expression (1):

$$W_1 \geqq H \quad (1)$$

while the width $W_1$ and width $W_2$ of the lower end at the bottom of the recess of the substrate in the planar direction satisfy the expression (2):

$$W_1 \leqq W_2 \quad (2).$$

2. The piezoelectric ink jet head according to claim 1, wherein the partition walls are formed with such a cross sectional shape as width $W_1$ and width $W_2$ satisfy the expression (2-1):

$$W_1 < W_2 \quad (2\text{-}1).$$

* * * * *